United States Patent [19]

Davis et al.

[11] Patent Number: 4,960,390

[45] Date of Patent: Oct. 2, 1990

[54] STRAIN RELIEF

[75] Inventors: Wayne S. Davis, Harrisburg; Michael E. Shirk, Grantville; Robert N. Whiteman, Jr., Middletown, all of Pa.

[73] Assignee: AMP Incorporated, Harrisburg, Pa.

[21] Appl. No.: 471,319

[22] Filed: Jan. 29, 1990

[51] Int. Cl.[5] ..... H01R 13/58

[52] U.S. Cl. ..... 439/459; 439/404

[58] Field of Search ..... 439/404, 405, 417, 459, 439/465, 467, 470, 460, 456

[56] References Cited

U.S. PATENT DOCUMENTS

| | | | |
|---|---|---|---|
| 3,820,055 | 9/1974 | Huffnagle et al. | 339/17 F |
| 4,025,142 | 5/1977 | Huber et al. | 339/128 |
| 4,095,870 | 6/1978 | Mathe | 439/459 |
| 4,111,512 | 9/1978 | Parmer et al. | 339/105 |
| 4,359,257 | 11/1982 | Lopinski et al. | 339/99 R |
| 4,475,786 | 10/1984 | Root et al. | 339/99 R |
| 4,603,475 | 8/1986 | Schützle | 29/857 |
| 4,655,528 | 4/1987 | Groft | 339/99 R |
| 4,668,039 | 5/1987 | Marzili | 339/99 R |
| 4,681,382 | 7/1987 | Lockard | 439/92 |
| 4,693,533 | 9/1987 | Szczesny et al. | 439/350 |
| 4,781,615 | 11/1988 | Davis et al. | 439/417 |

*Primary Examiner*—Gary F. Paumen

*Attorney, Agent, or Firm*—David L. Smith

[57] ABSTRACT

There is disclosed a connector (20) for terminating to a plurality of conductors (64). The connector includes a housing (24) having conductor terminating contacts (26) secured therein and defining an axis. First and second terminating covers (28,30) are adapted to be secured to the housing (24) from opposed directions, transverse to the axis of the contacts in a terminating position in which the conductors (64) are terminated to respective ones of the contacts (26), with the terminated conductors extending rearwardly of the housing (24) substantially parallel to the axis. A strain relief member (22) adapted to be secured to the housing (24) includes a transverse member (126) and cover retention means (138,140). The transverse member (126) intersects the rearwardly extending conductors (64) when the strain relief member (22) is secured to a housing (24) terminated to conductors (64) and causes the conductors to extend transverse to the contact axis to pass beyond the transverse member (126). The cover retention means (138,140) extend from the transverse member (126) proximate the terminating covers (28,30) and provide retention means for maintaining the terminating covers in their terminated position.

23 Claims, 4 Drawing Sheets

STRAIN RELIEF

BACKGROUND OF THE INVENTION

This invention relates to providing strain relief in an electrical connector conductor-to-contact terminations and in particular to a strain relief member for securing opposed termination covers in a terminated position while providing strain relief to conductors terminated to the contacts in the connector and extending rearwardly therefrom transverse to the direction the opposed termination covers are retained on the connector.

Providing strain relief for conductors terminated to contacts in a connector, such as mass terminated ribbon cable conductors, has typically been provided by passing the conductors over the connector perpendicular to the axis of the contacts and pressing a mass termination cover toward the connector parallel to the axis of the contacts. The mass termination cover typically assists in aligning the conductors of the ribbon cable with respective contacts, moves the cable parallel to the axis of the contacts until the conductors are terminated, and is secured to the connector axially with respect to the contacts. Typical of this type of conductor termination are U.S. Pat. Nos. 3,820,055; 4,025,142; 4 111 512; 4,359,257; 4,475,786; 4,603,475; 4,655,528; 4,668,039; 4,681,382; and 4,693,533.

While compressing the cable between the connector and terminating cover provides some strain relief, often additional strain relief is desired. To provide improved strain relief, the cable is folded back over the terminating cover and a strain relief cover is secured to the connector and terminating cover. The strain relief cover is pressed axially in the direction of the contacts to trap the cable between the strain relief cover and the terminating cover with the cable exiting either to the side of the connector as in U.S. Pat. Nos. 4,111,512 and 4,693,533 or to the rear of the connector as in U.S. Pat. No. 4,603,475.

SUMMARY OF THE INVENTION

In accordance with the present invention, a connector is provided for terminating to a plurality of conductors. The connector includes a housing having conductor terminating contacts secured therein and defining an axis. First and second terminating covers are adapted to be secured to the housing from opposed directions, transverse to the axis of the contacts in a terminating position in which the conductors are terminated to respective ones of the contacts, with the terminated conductors extending rearwardly of the housing substantially parallel to the axis. A strain relief member adapted to be secured to the housing includes a transverse member and cover retention means. The transverse member intersects the rearwardly extending conductors when the strain relief member is secured to a housing terminated to conductors and causes the conductors to extend transverse to the contact axis. The cover retention means extend from the transverse member proximate the terminating covers and provide retention means for maintaining the terminating covers in their terminated position.

DESCRIPTION OF THE PREFERRED EMBODIMENT

Figure 1:
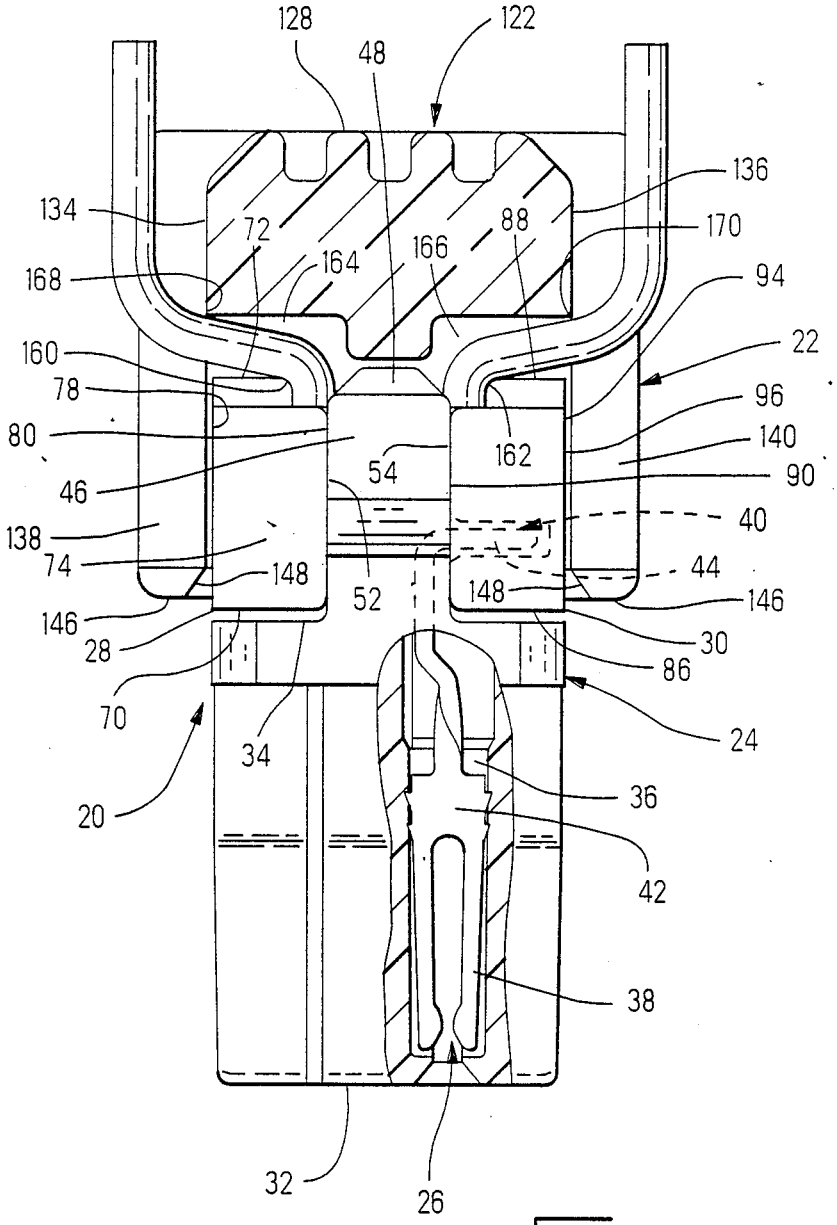
FIG. 1 is an end view of a connector with the strain relief member of the present invention partially cut away.
Figure 2:
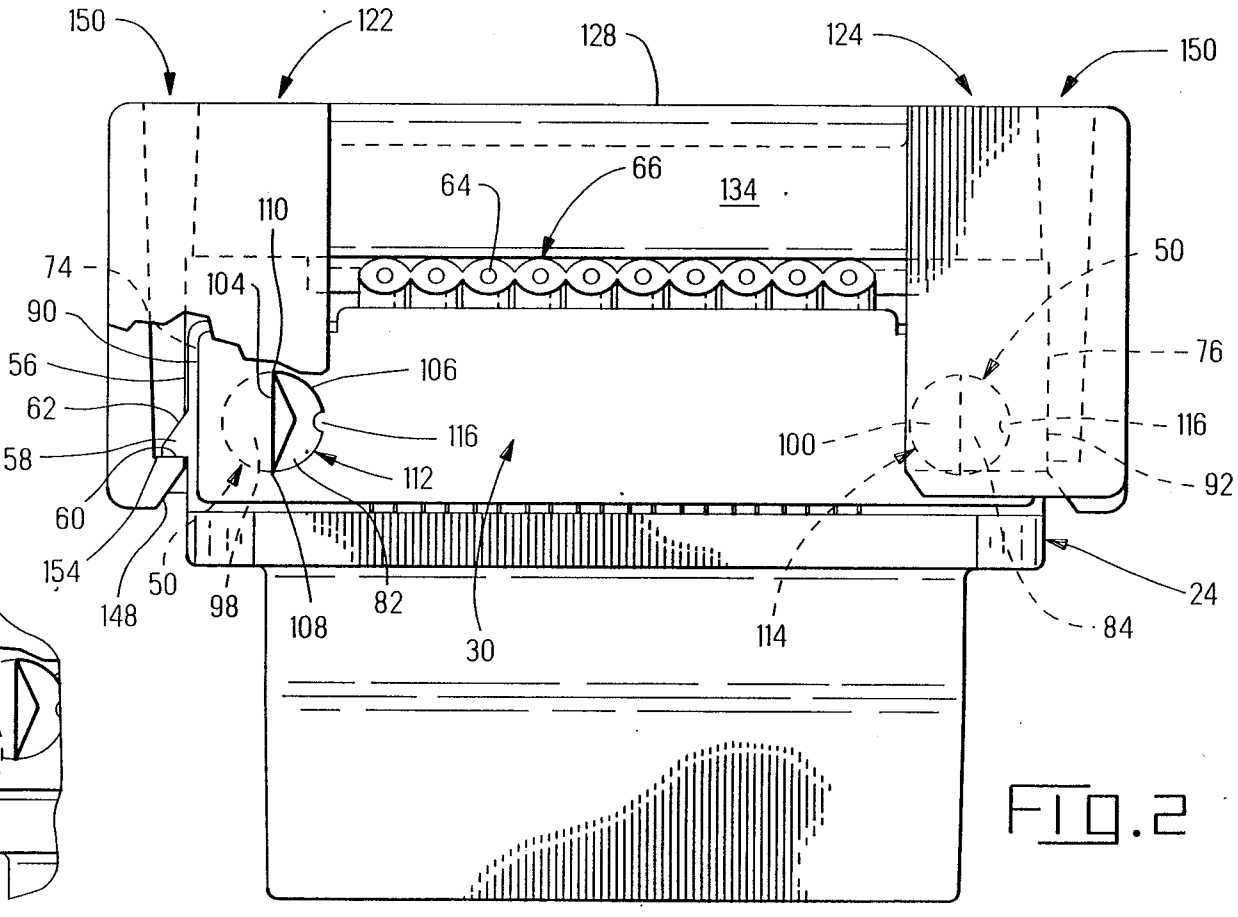
FIG. 2 is a side view of a connector with the strain relief member of the present invention partially cut away.

FIGS. 1 and 2 show respectively an end view and a side view of a connector 20 with the strain relief member 22 of the present invention. Connector 20 is comprised of elongate housing 24, molded of thermoplastic material, substantially in accordance with the teaching of U.S. Pat. No 4,781,615, the teaching of which is hereby incorporated by reference, conductor terminating contacts 26 and first and second terminating covers 28,30 also molded of thermoplastic material. Housing 24 has mating face 32, opposed rear face 34 and a plurality of contact receiving passages 36 extending therebetween Mating face 32 may provide a polarization feature by having a trapezoidal or subminiature D shape. In a preferred embodiment, passages 36 are arranged in two rows with contacts 26 secured therein. Contacts 26 include a mating portion 38, which may be a pin or receptacle, extending toward mating face 32, a conductor engaging portion 40 extending toward rear face 34 and a retention portion 42 therebetween Each passage 36 defines an axis from mating face 32 to rear face 34 that, in the preferred embodiment, substantially coincides with the axis of a contact 26 received therein, the axis of the contact extending through the mating portion 38 and retention portion 42. Conductor engaging portion 40 includes a slotted insulation displacement plate 44 extending substantially normal to the axis of contacts 26.

Terminal support block 46 extends rearward from rear face 34 between the two rows of contact receiving passages 36, terminating at rear wall 48. Terminal support block 46 includes spaced apertures 50 (one of which is shown in phantom FIG. 2) near the ends thereof Insulation displacement plates 44 extend normal to block 46 away from surface 52 for one row of contacts and away from surface 54 the other row of contacts. In this manner, the insulation displacement plates for each row of contacts extend in opposed directions. During termination of conductors in insulation displacement plates 44, the plates 44 bear on respective recesses from surfaces 52 or 54 of block 46. Connector 20 may terminate cross-section 64 of either a ribbon cable 66 or a round cable, either of which may be shielded or unshielded.

Figure 2A:
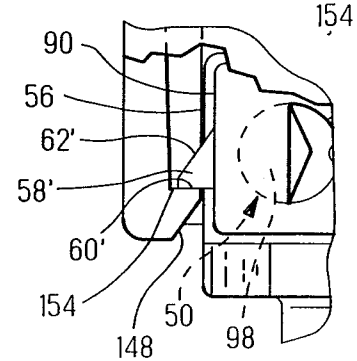
FIG. 2A is a partial side view of a connector similar to the connector shown in FIG. 2 wherein the strain relief member is secured to a termination cover.
Figure 3:
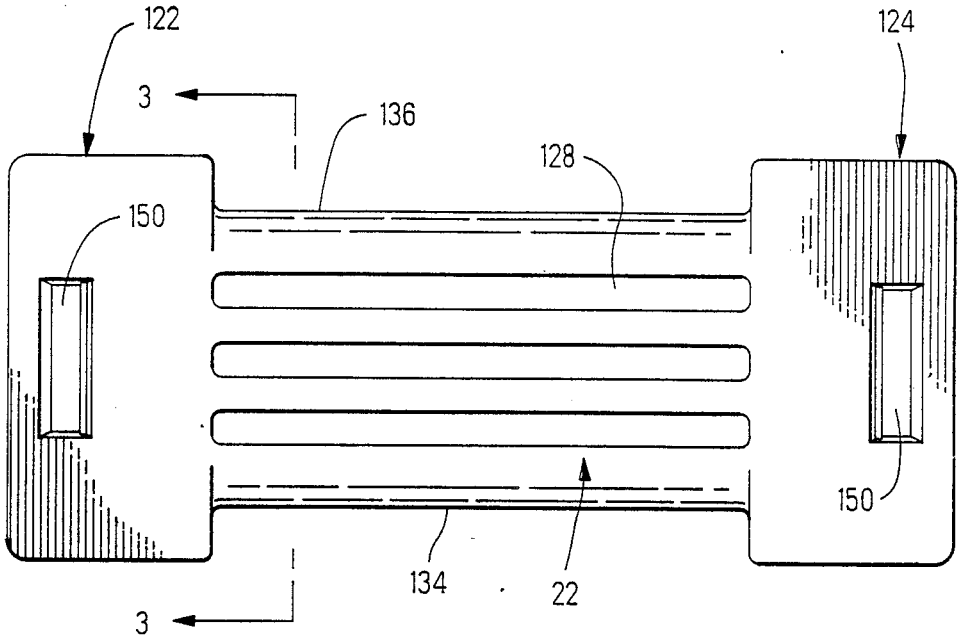
FIG. 3 is a top view of the strain relief member.
Figure 4:
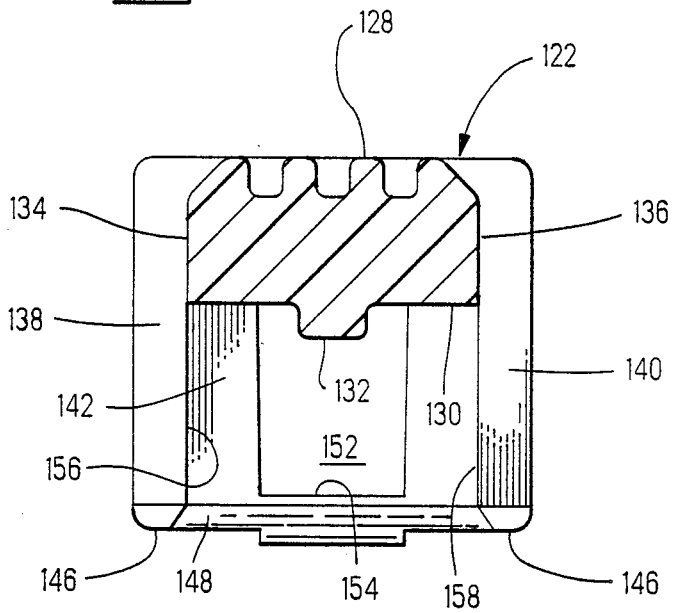
FIG. 4 is an end view, partially cut away, of the strain relief member.
Figure 5:
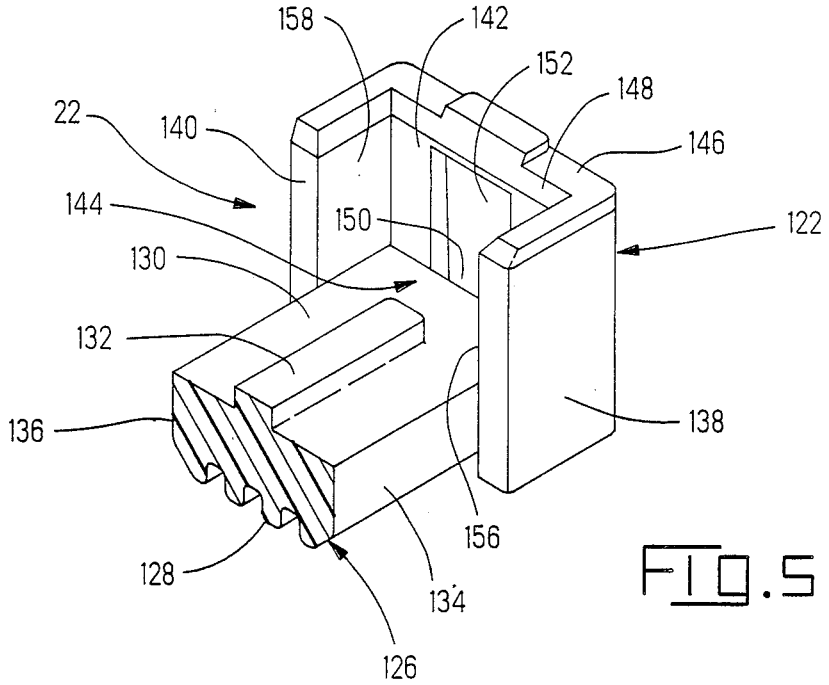
FIG. 5 is a bottom perspective view of an end of the strain relief member, partially cut away.
Figure 6:
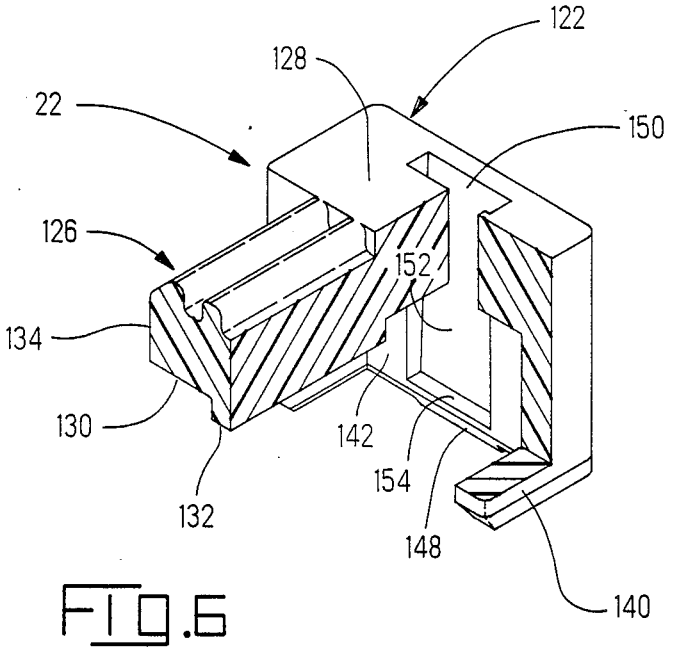
FIG. 6 is a top perspective view of an end of the strain relief member, partially cut away.

Extending outwardly from each end wall 56 of housing 24 is a latching protrusion 58 as best seen in FIG. 2. Latching protrusion 58 cooperates with the complementary latch means on strain relief 22 to secure strain relief 22 to housing 24. Each latching protrusion 58 provides a latching surface 60 facing mating face 32 and a ramped surface 62 extending away from mating face 32 and inwardly from latching surface 62 to a respective end wall 56. Latching surface 60 may provide a reverse angle as known in the art. Alternatively, the latching protrusion 58' could be on ends of one or both of the terminating covers as shown in FIG. 2A, providing a ramped surface 60' and latch shoulder 62'.

Terminating cover 28 is elongate having opposed side walls 70,72, opposed end walls 74,76, outer surface 78 and opposed inner surface 80, a portion of which may be fluted. Spaced leg means 82,84 extend from inner surface 80 proximate end walls 74,76 and are spaced to be received in apertures 50 of housing 24.

Terminating cover 30 is elongate having opposed side walls 86,88, opposed end walls 90,92, outer surface 94 and opposed inner surface 96, a portion of which may be fluted. Spaced leg means 98,100 extend from inner surface 96 proximate end walls 90,92 and are spaced to be received in apertures 50.

The cross-section of leg means 82 on terminating cover 28 and leg means 98 on terminating cover 30 complement each other, as do the cross section of leg means 84 on terminating cover 28 and leg means 100 on terminating cover 30, to substantially fill apertures 50 and provide an interference fit with a side wall of aperture 50. In a preferred embodiment, leg means 82,84,98 and !00 have a cross-section that is a chordal section of a circle, such as a semi-circle, with a flat side 104 and a semi-cylindrical surface 106 defining corners 108,!10 at their intersections. Adjacent the leg means are apertures 112,114 in at least one, and typically both, of the terminating covers 28,30. Apertures 112,114 in one of the terminating covers has a protrusion or rib 116 extending thereinto.

Terminating cover 28 is positioned adjacent surface 52 of block 46 and terminating cover 30 is positioned adjacent surface 54 of block 46, with respective leg means aligned with and directed toward apertures 50. Terminating covers 28,30 are moved toward block 46 and toward each other such that leg means 82,84,90 and 100 are received in respective apertures 50 in an interference fit to assemble terminating covers 28,30 to housing 24 in a pre-termination position. In the pre-termination position inner surfaces 80 and 96 are spaced from respective insulation displacement plates to receive a planar array of conductors of cable 66 therebetween. In this position, a corner 108,110 of each leg means 82,84,98,!00 engages wall means of one of apertures 50 to secure terminating covers 28,30 in the pre-termination position.

Subsequent to inserting conductors 64 between inner surfaces 80,96 and respective plates 44, a terminating force is applied to terminating covers 28,30 such as with a press or hand tool, to move the terminating covers 28,30 to a termination position and in the process to terminate conductor 64 of cable 66 to respective plates 44 of contacts 26. The terminating force moves each terminating cover 28,30 toward block 46 and toward each other such that the leading end of leg means of each terminating cover enter the aperture 112,114 in the other terminating cover and enter an interference fit with rib 116 therein. This interference fit with rib 116 provides interference fit between rib 116 and the respective leg means engaged thereby on a surface of the leg means that was not previously deformed by an interference fit. This interference fit assures that terminating covers 28,30 are secured in the termination position with conductors 64 of cable 66 terminated to respective plates of contacts 26.

Strain relief member 22 is elongate having two substantially identical ends 122,124 with interconnecting cross member 126 therebetween. Cross member 126 is formed with outer surface 128, inner surface 130 which may have lengthwise reinforcement rib 132 upstanding therefrom, major side edges 134,136 which may be recessed between the ends 122,124 to accommodate conductors 64. Strain relief member 22 is typically molded of the same thermoplastic material as the connector housing and terminating covers.

Each end 122,124, in the preferred embodiment, has a first and second side wall 138,140 ®extending along and integral with a portion of side edges 134,136 respectively. The side walls join end wall 142 to define a U-shaped structure defining a three sided cavity 144 at the extremities of cross member 126 extending substantially normal to and beyond inner surface 130 to a terminating edge 146 having a taper 148. End walls 142 extend from and are integral with minor sidewalls of cross member 126.

Aperture 150 passes through cross member 126 between outer surface 128 and inner surface !30 near end wall 142 such as to permit withdrawal of a core pin that forms recess channel 152 and latch shoulder 154 during molding thereof. Aperture 152 is also useful for insertion of tooling to remove strain relief member 22 from housing 24.

With terminating covers 28,30 in the termination position and conductors 64 terminated to respective contacts 26, conductors 64 extend rearwardly from between the inner surface 80 of the terminating covers 28,30 and a respective surface 52,54 of terminal support block 46 in two rows. The two rows of conductors are separated to receive cross member 126 therebetween. Strain relief member 22 is positioned with inner surface 130 facing toward connector 20 and pressed toward the rear of connector 20. Taper 148 on side walls 138,140 and end walls 142 assist to position strain relief member 22 relative to terminating covers 28,30. As the edges of the terminating covers move past taper 148 and into cavity 144, terminating covers 28,30 are prevented from moving out of the termination position. The terminating covers are prevented from moving from the termination position as the outer surface 78 of terminating cover 28 is received adjacent to, and may engage, the inner surface 156 of side wall 138 and outer surface 94 of terminating cover 30 is received adjacent to, and may engage, the inner surface 158 of side wall 140.

As strain relief member 22 moves toward a secured position, taper 148 on endwall 142 engages and rides up ramped surface 62, simultaneously causing the central portion of end wall 142 to flex outwardly and cross member 126 to bow. When latch shoulder 154 passes over the apex formed at the intersection of ramped surface 62 and latching surface 60, cross member 126 resiles and end wall 142 resiles inwardly such that latch shoulder 154 engages latching surface 60 to latchingly secure strain relief member 22 on connector 20. With strain relief member 22 secured on connector 20, rib 132 may, but likely does not, engage rear wall 48 of terminal support block 46. Conductors 64 take the circuitous path shown in FIG. 1, extending rearwardly from the connector housing in two rows emanating from between a terminating cover 28,30 and terminal support block 46 to fold around a respective corner 160,162 in a channel-like space 164,166 thence fold around a corner 168,170 of strain relief member 22 at the respective intersection of side edges 134,136 and inner surface 130.

Enhanced strain relief is provided in the direction of the axis of contacts 26 by the change in direction of conductors 64 around corners 160,162 and 168,170. Enhanced strain relief is provided transverse to the axis of contacts 26 by side walls 138,140 maintaining the termination covers 28,30 in their terminated positions. Side walls 138,140 may engage termination covers 28,30 or be spaced slightly therefrom. When conductors 64 are clamped in spaces 164,166 between inner surface 130 and terminating cover side walls 72,80, strain relief is further enhanced.

While side walls 138,140 have been shown to depend from cross member 126 along side edges 134,136 and be integral with end wall 146, side walls 138,140 need not be integral with end wall 146 and may depend from either side walls 134,136 of cross member 126 or from end wall 148. The preferred embodiment has been disclosed with respect to an unshielded connector; the invention is not limited thereto and could equally be employed with a shielded connector. While the preferred embodiment has been described with respect to insulation piercing termination of the conductors to the contacts; other types of termination are contemplated within the scope of the invention.

We claim:

1. A connector for terminating to a plurality of conductors, the connector comprising:

a housing having conductor terminating contacts secured therein, each of said contacts defining a longitudinal axis, and first and second terminating covers, said first and second terminating covers adapted to be secured to the housing from opposed directions transverse to the axes of the contacts in a terminating position in which the conductors are terminated to respective ones of the contacts with the terminated conductors extending rearwardly of the housing substantially parallel to said axes; and one-piece strain relief means adapted to be secured to said housing by passing the strain relief means over at least a portion of said terminating covers in a direction parallel to said longitudinal axes, said strain relief means having a transverse member and a cover retention means, said transverse member adapted to intersect the rearwardly extending conductors when the strain relief means is secured to said housing when said housing is terminated to the conductors, and said transverse member adapted to cause the conductors to extend transverse to the longitudinal axes to pass laterally beyond the transverse member, said cover retention means extending from the transverse member proximate the terminating covers, said cover retention means for maintaining the termination covers in said terminating position.

2. A connector as recited in claim 1, wherein the cover retention means extend from major side edges of said transverse member.

3. A connector as recited in claim 1, wherein the cover retention means extend from minor side edges of said transverse member.

4. A connector as recited in claim 1, wherein the cover retention means extend normal to the opposed directions from which the terminating covers are secured to the housing.

5. A connector as recited in claim 1, wherein an inner surface of the cover retention means engages an exterior surface of each of the terminating covers.

6. A connector as recited in claim 1, wherein the housing has a protrusion providing a latch shoulder to which the strain relief means is secured.

7. A connector as recited in claim 1, wherein a said terminating cover has a protrusion providing a latch shoulder to which the strain relief means is secured.

8. A connector for terminating to a plurality of conductors, the connector comprising:

a housing having conductor terminating contacts secured therein, each of said contacts defining a longitudinal axis, and first and second terminating covers, said first and second terminating covers adapted to be secured to the housing from opposed directions transverse to the axes of the contacts in a terminating position in which the conductors are terminated to respective ones of the contacts with the terminated conductors extending rearwardly of the housing substantially parallel to said axes; and one-piece strain relief means adapted to be secured to said housing by passing the strain relief means over at least a portion of said terminating covers in a direction parallel to said longitudinal axes, said strain relief means having a transverse member and a cover retention means, said transverse member adapted to intersect the rearwardly extending conductors when the strain relief means is secured to said housing when said housing is terminated to the conductors, and said transverse member adapted to channel the conductors transverse to the longitudinal axes to pass laterally beyond the transverse member to provide strain relief to the conductors, said cover retention means extending from the transverse member proximate the terminating covers, said cover retention means for maintaining the termination covers in said terminating position.

9. A connector as recited in claim 8, wherein the cover retention means extend from major side edges of said transverse member.

10. A connector as recited in claim 8, wherein the cover retention means extend from minor side edges of said transverse member.

11. A connector as recited in claim 8, wherein the cover retention means extend normal to the opposed directions from which the terminating covers are secured to the housing.

12. A connector as recited in claim 8, wherein an inner surface of the cover retention means engages an exterior surface of each of the terminating covers.

13. A connector as recited in claim 8, wherein the strain relief means is being adapted to channel the conductors to extend transverse to contact axes is adapted to channel the conductors to extend beyond the transverse member to provide strain relief thereto.

14. A connector as recited in claim 8, wherein the housing has a protrusion providing a latch shoulder to which the strain relief means is secured.

15. A connector as recited in claim 8, wherein a said terminating cover has a protrusion providing a latch shoulder to which the strain relief means is secured.

16. A connector for terminating to a plurality of conductors, the connector comprising:

a housing having conductor terminating contacts secured therein, each of said contacts defining a longitudinal axis, and having at least one terminating cover, said at least one terminating cover adapted to be secured to the housing from a direction transverse to the axis of the contacts in a terminating position in which the conductors are terminated to respective ones of the contacts with the terminated conductors extending rearwardly of the housing substantially parallel to said axes; and one-piece strain relief means adapted to be secured to said housing by passing the strain relief means over at least a portion of said terminating covers in a direction parallel to said longitudinal axes, said strain relief means having a transverse member and a cover retention means, said transverse member adapted to intersect the rearwardly extending conductors when the strain relief means is secured to said housing when said housing is terminated to the conductors, and said transverse member adapted to channel the conductors transverse to the longitudinal axes to pass laterally beyond the transverse member to provide strain relief to the conductors, transverse member proximate said at least one terminating cover, said cover retention means for maintaining said at least one termination cover in said terminating position.

17. A connector as recited in claim 16, wherein the cover retention means extend from major side edges of said transverse member.

18. A connector as recited in claim 16, wherein the cover retention means extend from minor side edges of said transverse member.

19. A connector as recited in claim 16, wherein the cover retention means extend normal to the opposed directions from which said at least one terminating cover is secured to the housing.

20. A connector as recited in claim 16, wherein an inner surface of the cover retention means engages an exterior surface of said at least one terminating cover.

21. A connector as recited in claim 16, wherein the strain relief means is being adapted to channel the conductors to extend transverse to contact axes is adapted to channel the conductors to extend beyond the transverse member to provide strain relief thereto.

22. A connector as recited in claim 16, wherein the housing has a protrusion providing a latch shoulder to which the strain relief means is secured.

23. A connector as recited in claim 16, wherein said at least one terminating cover has a protrusion providing a latch shoulder to which the strain relief means is secured.

* * * * *